US011447999B2

(12) United States Patent
Uno et al.

(10) Patent No.: US 11,447,999 B2
(45) Date of Patent: Sep. 20, 2022

(54) NOTIFICATION DEVICE AND DOOR OPENING-CLOSING DEVICE

(71) Applicant: NABTESCO CORPORATION, Tokyo (JP)

(72) Inventors: Hiroki Uno, Tokyo (JP); Takuya Yokomoto, Tokyo (JP)

(73) Assignee: NABTESCO CORPORATION, Tokyo (JP)

( * ) Notice: Subject to any disclaimer, the term of this patent is extended or adjusted under 35 U.S.C. 154(b) by 517 days.

(21) Appl. No.: 16/660,013

(22) Filed: Oct. 22, 2019

(65) Prior Publication Data

US 2020/0149339 A1 May 14, 2020

(30) Foreign Application Priority Data

Nov. 8, 2018 (JP) ..... JP2018-210422

(51) Int. Cl.
*E05F 15/60* (2015.01)
*B61D 19/00* (2006.01)

(52) U.S. Cl.
CPC ..... *E05F 15/60* (2015.01); *B61D 19/005* (2013.01); *E05Y 2900/51* (2013.01); *E05Y 2900/531* (2013.01)

(58) Field of Classification Search
CPC ... E05F 15/60; B61D 19/005; E05Y 2900/51; E05Y 2900/531
See application file for complete search history.

(56) References Cited

U.S. PATENT DOCUMENTS

2014/0335771 A1* 11/2014 Kikuchi ..... H01M 10/613 454/75
2015/0059247 A1* 3/2015 Inatama ..... E05F 15/632 49/13
2015/0251673 A1 9/2015 Kessner
2016/0194017 A1 7/2016 Schmale et al.

FOREIGN PATENT DOCUMENTS

CN 106183823 A 12/2016
JP 2005-041384 A 2/2005
WO 2014/053318 A2 4/2014

OTHER PUBLICATIONS

Extended European Search Report dated Aug. 18, 2020 issued in corresponding European Patent Application No. 19204557.3 (7 pgs.).
Office Action dated Dec. 2, 2020 issued in corresponding Chinese Patent Application No. 201911015679.0 (7 pgs).

* cited by examiner

*Primary Examiner* — Nabil H Syed
(74) *Attorney, Agent, or Firm* — Pillsbury Winthrop Shaw Pittman, LLP

(57) ABSTRACT

A notification device includes a notification line for notifying a vehicle control device that a door is closed, a first door lock switch that electrically connects the notification line when the door is closed and disconnects the notification line when the door is opened, and an interruption unit that interrupts a signal transmitted through the notification line when an abnormality of the first door lock switch is detected.

7 Claims, 5 Drawing Sheets

NOTIFICATION DEVICE AND DOOR OPENING-CLOSING DEVICE

CROSS-REFERENCE TO RELATED APPLICATIONS

This application is based on and claims the benefit of priority from Japanese Patent Application Serial No. 2018-210422 (filed on Nov. 8, 2018), the contents of which are hereby incorporated by reference in its entirety.

TECHNICAL FIELD

The present invention relates to a notification device and a door opening-closing device.

BACKGROUND

A railway vehicle described in Japanese Patent Application Publication No. 2005-41384 ("the '384 Publication") is equipped with a control device that controls various operations of the railway vehicle. The control device supplies a signal to a driving device for running the vehicle via an activation circuit. Specifically, a signal indicating that a door is closed is supplied from a door close detection unit to the control device. The control device switches the contact (switch) of the activation circuit to a conducting state when the door close detection unit detects the closed state of the door.

If any abnormality occurs at the contact of the activation circuit in the railway vehicle described in the '384 Publication, the contact of the activation circuit may unintentionally stay in the conducting state regardless of whether or not the door is actually open. In this case, there is a possibility that the driving device be notified that the door is in the closed state from the activation circuit even though the door is actually in the opened state.

SUMMARY

According to one aspect of the invention, provided is a notification device that includes a notification line for notifying an upper-level device that a door is closed, a door switch allowing the notification line to be in a signal transmitted state when the door is closed and allowing the notification line to be in a signal interrupted state when the door is opened, and an interruption unit allowing the notification line to be in the signal interrupted state when an abnormality of the door switch is detected.

In the above configuration, the interruption unit makes the notification line in the signal interrupted state when an abnormality of the door switch is detected. Therefore, when an abnormality is detected in the door switch, it is possible avoid that the upper-level device is notified of the closed state of the door even though door is actually opened via the notification line.

In the notification device, the interruption unit may detect whether the door switch is stuck while the notification line is in the signal transmitted state, and the interruption unit causing the notification line to be in the signal interrupted state when it is determined that the door switch is stuck and an abnormality of the door switch has occurred. With such a configuration, it is possible to detect that the door switch is stuck as an abnormality of the door switch, and to make the notification line in the signal interrupted state when the door switch is stuck.

In the notification device, the interruption unit may switch the notification line from the signal interrupted state to the signal transmitted state on condition that a closed state of the door is detected. With such a configuration, even when an abnormality of the door switch occurs, the notification line can be switched to the signal transmitted state when the door is actually closed.

In the notification device, the interruption unit may include a first branch branched from the notification line on one side of the notification line with reference to the door switch, a first determination relay causing the first branch to be in a signal transmitted state or a signal interrupted state, a second branch branched from the notification line on the other side of the notification line with reference to the door switch, a second determination relay causing the second branch to be in a signal transmitted state or a signal interrupted state, and a determination unit. The determination unit determines that the door switch is stuck while the door switch keeps causing the notification line to be in the signal transmitting state when the first determination relay causing the first branch to be in the signal transmitted state, the second determination relay causing the second branch to be in the signal transmitted state, the door is opened, and a signal is supplied via the first branch and the second branch.

With the above configuration, it is possible to determine whether the door switch is stuck with a relatively simple circuit configuration in which branches and relays are provided on both sides of the door switch in the notification line. Therefore, it is possible to apply a configuration for determining whether the door switch is stuck to conventional apparatus without a large design change of the notification line or the door switch itself.

In the notification device, the interruption unit may include a first interruption relay provided in the first branch on the one side of the notification line with respect to a branching point of the first branch, the first interruption relay allowing the notification line to be in the signal interrupted state in conjunction with the first determination relay causing the first branch to be in the signal transmitted state, and the first interruption relay allowing the notification line to be in the signal transmitted state in conjunction with the first determination relay causing the first branch to be in the signal interrupted state. The interruption unit may further include a second interruption relay provided in the second branch on the other side of the notification line with respect to a branching point of the second branch, the second interruption relay allowing the notification line to be in the signal interrupted state in conjunction with the second determination relay causing the second branch to be in the signal transmitted state, and the second interruption relay allowing the notification line to be in the signal transmitted state in conjunction with the second determination relay causing the second branch to be in the signal interrupted state. The determination unit determines whether the door switch is stuck while the notification line is made in the signal interrupted state by the first interruption relay and the second interruption relay.

According to the above configuration, when the determination unit determines whether the door switch is stuck, the first interruption relay and the second interruption relay cause the notification line to be in the signal interrupted state regardless of whether or not the door switch is actually stuck. Therefore, it is possible to prevent an unintended signal from being transmitted to the upper-level device via the notification line when the determination of sticking of the door switch is performed.

The notification device may further include a bypass line connecting the one side of the notification line with respect to the first interruption relay and the other side of the notification line with respect to the second interruption relay, and a bypass switch allowing the bypass line to be in a signal transmitted state or a signal interrupted state.

According to the above configuration, when the bypass switch puts the bypass line into the signal passing state, the notification line bypasses the relays and switch regardless of whether or not a signal is able to pass through the first interruption relay, the door switch, and the second interruption relay. Therefore, regardless of the states of the first interruption relay, the door switch, and the second interruption relay, it is possible to allow signal to be transmitted or interrupted to the upper-level device through the bypass line.

In the above notification device, the door switch may be a door lock switch that allows the notification line to be in the signal transmitted state when the door is closed and locked and allows the notification line to be in the signal interrupted state when the door is unlocked.

In the above configuration, the notification line is switched to the signal transmitted state not only when the door is closed but also when the door is locked. This is preferable in the management of the opening-closing function of the door to set, as a target of abnormality determination, the door lock switch switched in accordance with locking of the door.

According to another aspect of the invention, provided is a door opening-closing device that includes a driving device driving a door to be opened and closed, a control unit controlling the driving device, and a notification device. The notification device includes a notification line for notifying an upper-level device that the door is closed, a door switch allowing the notification line to be in a signal transmitted state when the door is closed and allowing the notification line to be in a signal interrupted state when the door is opened, and an interruption unit allowing the notification line to be in the signal interrupted state when an abnormality of the door switch is detected.

In the above door opening-closing device, the notification line is made in the signal interrupted state when an abnormality of the door switch is detected regardless of whether the door switch causes the notification line to be in the signal transmitted state. Therefore it is possible avoid that the upper-level device is notified of the closed state of the door even though door is actually opened via the notification line due to the abnormality of the door switch.

According to the aspects of the invention, it is possible avoid that the upper-level device is notified of the closed state of the door even though door is actually opened due to the abnormality of the door switch.

DESCRIPTION OF THE EMBODIMENTS

Figure 1:
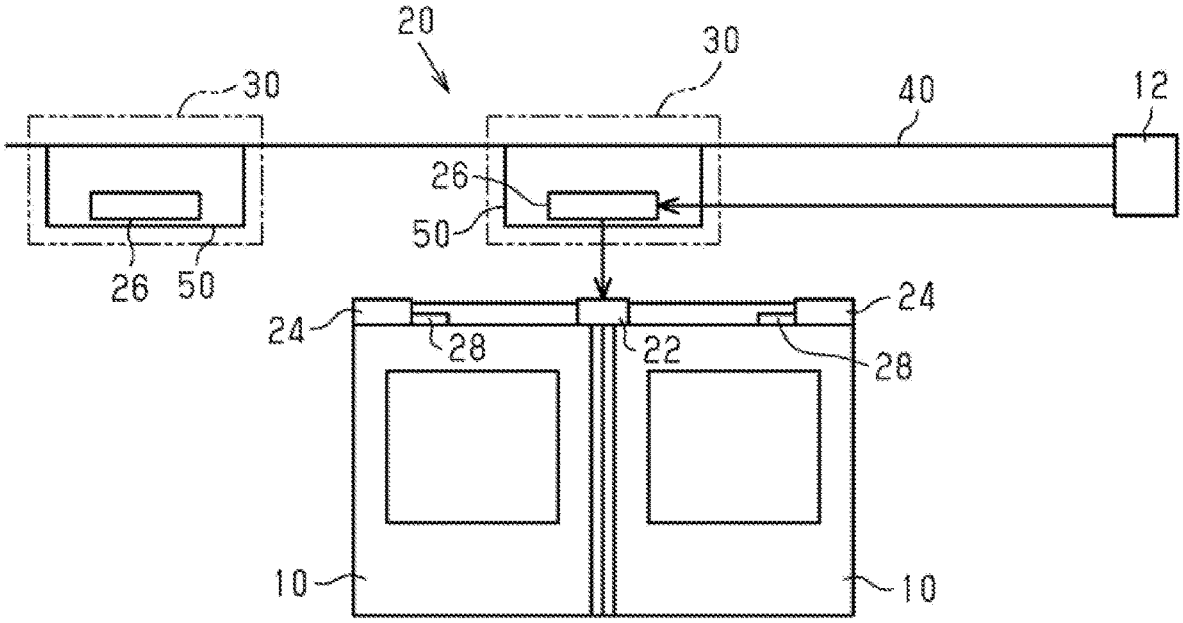
FIG. 1 is a schematic view of a mechanism related to opening and closing of a door of a railway vehicle.

An embodiment of a door opening-closing device equipped with a notification device will be now described with reference to the accompanying drawings. A schematic configuration of a door of a railway vehicle and a door opening-closing device will be first described. As shown in FIG. 1, the railway vehicle is provided with a door 10 that is opened and closed to open and close its doorway (opening) of the railway vehicle. The door 10 is a bi-parting door set. The door 10 is a sliding door whose two leaves slide in front and rear directions of the vehicle respectively. The two leaves of door set 10 slide in directions away from each other when the door 10 is opened to open the doorway, and slide in directions coming close to each other when the door 10 is closed to close the doorway. The railway vehicle is provided with a plurality of doorways and a plurality of the door sets 10 corresponding thereto, but only one door set 10 (two leaves) is shown in FIG. 1.

The railway vehicle is equipped with a door opening-closing device 20 for driving and controlling the door 10. The door opening closing device 20 includes an electric motor 22 as a driving device disposed around the door 10, specifically, at an upper edge of the doorway of the railway vehicle. The electric motor 22 is coupled to the door 10 via a door drive mechanism 24 that includes a wire, a pulley and the like. The door 10 is opened when an output shaft of the electric motor 22 rotates in one direction, and the door 10 is closed when the output shaft of the electric motor 22 rotates in the other direction.

The door opening-closing device 20 includes a lock mechanism 28 locking the door set 10 that is fully closed. The lock mechanism 28 is provided for each leaf of the door set 10. That is, two lock mechanisms 28 are provided for each door set 10. Although not shown, the lock mechanism 28 includes a lock pin that is protrudable toward the door 10 and retractable therefrom. The lock pin of the lock mechanism 28 is inserted into a hole in the door 10 that is fully closed, thereby the door 10 is locked in a state where the door 10 is prohibited from moving.

The door opening-closing device 20 includes a door control unit 26 as a controller that controls the electric motor 22 and the lock mechanism 28. The door control unit 26 is a computer that includes a nonvolatile storage unit storing various programs (software), a CPU executing the various programs, a volatile RAM temporarily storing data when the programs are executed, and the like. In this embodiment, the door control unit 26 is mounted in the vicinity of the doorway of the railway vehicle for each door set 10.

When the door 10 in the fully closed state is driven to an opened state, the door control unit 26 controls the lock mechanism 28 so as to unlock the door set 10. Thereafter, the door control unit 26 controls the electric motor 22 such that the output shaft of the electric motor 22 rotates in one direction. Whereas when the door 10 in the opened state is driven to a closed state, the door control unit 26 controls the electric motor 22 such that the output shaft of the electric motor 22 rotates in the other direction. After the door 10 is fully closed, the door control unit 26 controls the lock mechanism 28 so that the door 10 is locked.

The door control unit 26 provided for each door set 10 operates based on a command from a vehicle control device 12 that serves as an upper-level device to control traveling of the railway vehicle, opening and closing of the door 10 and the like. The vehicle control device 12 is a computer that includes a nonvolatile storage unit storing various programs (software), a CPU executing the various programs, a volatile RAM temporarily storing data when the programs are executed, and the like. In this embodiment, the vehicle control device 12 is mounted in a cab of the railway vehicle.

The door opening-closing device 20 includes a notification device 30 that notifies the vehicle control device 12 that the door 10 is in the closed state. The notification device 30 is provided for each door set 10. In this embodiment, the notification device 30 includes the above-mentioned door control unit 26.

Next, a description is given of a circuit configuration of the notification device 30. As illustrated in FIG. 1, the notification device 30 includes a notification line 40 that is an electrical wiring for notifying the vehicle control device 12 of the closed state of the door 10, and an interruption unit 50 that interrupts the notification line 40. Ends of the notification line 40 for the notification device 30 are electrically coupled to ends of the notification lines 40 of the adjacent two notification devices 30 respectively. That is, the notification devices 30 are electrically connected in series through the notification lines 40. One end of the notification line 40 is connected to a DC power source (not shown). The other end of the notification line 40 is connected to the vehicle control device 12. In the following description, the DC power supply side of the notification line 40 is referred to as a high voltage side, and the vehicle control device 12 side is referred to as a low voltage side. Once the notification line 40 becomes electrically conducting from the high-voltage side end to the low-voltage side end, a signal is supplied to the vehicle control device 12. This signal serves to inform the vehicle control device 12 that all the doors 10 of the vehicle are fully closed. Since the circuit configuration of each notification device 30 is the same except for the connection destination of the notification line 40, the notification device 30 closest to the vehicle control device 12 will be described below, and the description of the other notification devices 30 will be hereunder omitted.

Figure 2:
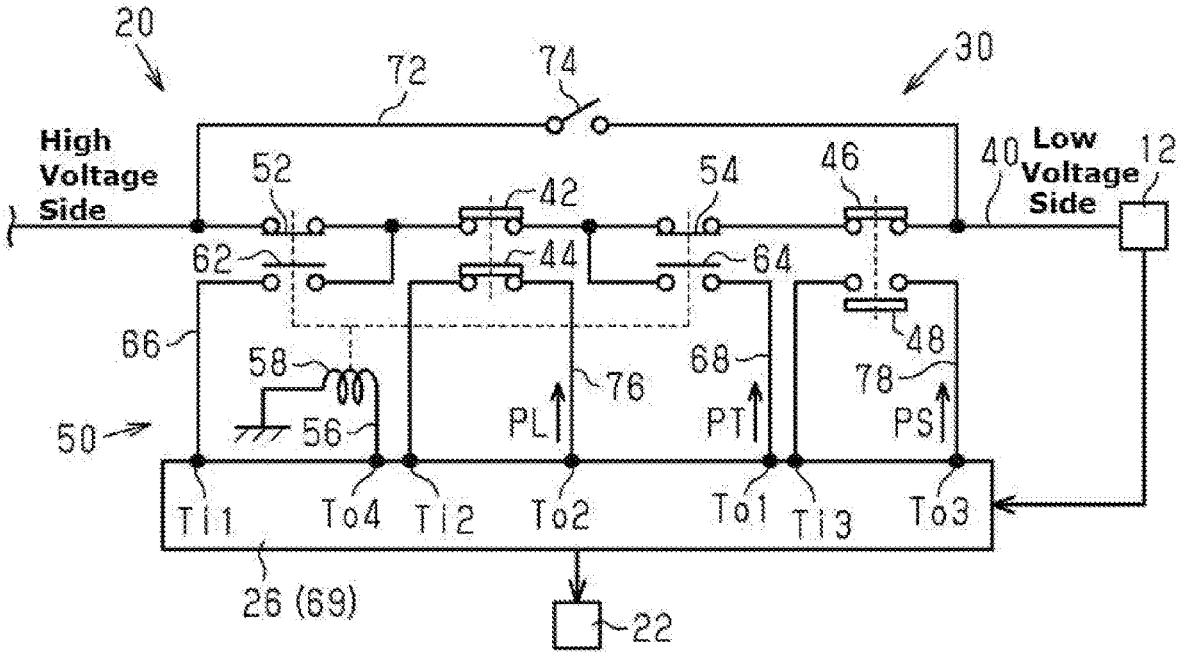
FIG. 2 is a circuit diagram of a notification device in a state where the door is locked.

As shown in FIG. 2, in the notification line 40, a first interruption relay 52 that switches between an electrically connected state (a signal transmitted state) and an electrically disconnected state (a signal interrupted state) of the notification line 40 is provided. A first branch 66 is branched from the notification line 40 on the low voltage side of the notification line 40 with reference to the first interruption relay 52. An end of the first branch 66 opposite to the notification line 40 is connected to a first input terminal Ti1 of the door control unit 26 in the door opening-closing device 20.

A first determination relay 62 that switches between electric connection and disconnection of the first branch 66 is provided in the first branch 66. The first determination relay 62 is mechanically connected to the first interruption relay 52 so as to be switched in conjunction with the first interruption relay 52. Specifically, the first determination relay 62 is switched to an interrupting state when the first interruption relay 52 is in a conducting state. Further, the first determination relay 62 is switched to the conducting state when the first interruption relay 52 is in the interrupting state.

A first door lock switch 42 is connected to the low voltage side of the notification line 40 with reference to the branching point of the first branch 66. Although detailed illustration is omitted, an action of the lock mechanism 28 is mechanically transmitted to the first door lock switch 42 via a transmission mechanism. Alternatively, the action of the lock mechanism 28 may be directly transmitted to the first door lock switch 42. The first door lock switch 42 is switched between a conducting state and an interrupting state in accordance with the action of the lock mechanism 28. The first door lock switch 42 electrically connects the notification line 40 when the door 10 is fully closed and locked. Whereas when the door 10 is unlocked, the first door lock switch 42 electrically disconnects the notification line 40. As described above, the first door lock switch 42 switches the notification line 40 between the conducted state and interrupted state depending on whether the door 10 is locked or unlocked by the lock mechanism 28. When the door 10 is locked by the lock mechanism 28, it is assumed that the door 10 is fully closed. Thus the first door lock switch 42 electrically connects the notification line 40 when the door 10 is fully closed and locked. When the door 10 is opened, it is assumed that the door 10 which has been locked by the lock mechanism 28 is unlocked. Thus when the door 10 is unlocked and opened, the first door lock switch 42 disconnects the notification line 40.

A second interruption relay 54 that switches between electric connection and disconnection of the notification line 40 is provided in the notification line 40 on the low voltage side with reference to the first door lock switch 42. A second branch 68 branches from the notification line 40 between the first door lock switch 42 and the second interruption relay 54. An end of the second branch 68 opposite to the notification line 40 is connected to a first output terminal To1 of the door control unit 26.

A second determination relay 64 that switches between connection and disconnection of the second branch 68 is provided in the second branch 68. The second determination relay 64 is mechanically connected to the second interruption relay 54 so as to be switchable in conjunction with the second interruption relay 54. Specifically, the second determination relay 64 is switched to the interrupting state when the second interruption relay 54 is in the conducting state. Further, the second determination relay 64 is switched to a conducting state when the second interruption relay 54 is in the interrupting state.

A first door close switch 46 is provided in the notification line 40 on the low voltage side with reference to the second interruption relay 54. Although detailed illustration is omitted, opening and closing actions of the door 10 are mechanically transmitted to the first door close switch 46 via a transmission mechanism. Alternatively the opening and closing actions of the door 10 may be directly transmitted to the first door close switch 46. The first door close switch 46 is switched between a conducting state and an interrupting state in accordance with opening and closing of the door 10. The first door close switch 46 electrically connects the notification line 40 when the door 10 is fully closed. Whereas when the door 10 is opened, the first door close switch 46 electrically disconnects the notification line 40. Thus, the first door close switch 46 switches the notification line 40 between the conducted state and the interrupted state depending on whether the door 10 is fully closed or opened.

A bypass branch 72 extends from the high voltage side of the notification line 40 with reference to the first interruption relay 52. A end of the of the bypass line 72 on the low voltage side is connected to a position closer to the low voltage side of the notification line 40 than the first door close switch 46. That is, the bypass line 72 bypasses the first interruption relay 52, the first door lock switch 42, the second interruption relay 54, and the first door close switch 46 on the notification line 40. On the bypass line 72, a bypass switch 74 for switching between connection and disconnection of the bypass line 72 is provided.

A door lock line 76 is connected to the door control unit 26. One end of the door lock line 76 is coupled to a second output terminal To2 of the door control unit 26. The other end of the door lock line 76 is coupled to a second input terminal Ti2 of the door control unit 26. A second door lock switch 44 is provided in the door lock line 76. Although detailed illustration is omitted, an action of the lock mechanism 28 is mechanically transmitted to the second door lock switch 44 via a transmission mechanism. Alternatively, the action of the lock mechanism 28 may be directly transmitted to the second door lock switch 44. The second door lock switch 44 is switched between a conducting state and an interrupting state in accordance with the action of the lock mechanism 28. The second door lock switch 44 is switched to the conducting state when the door 10 is fully closed and locked. Whereas when the door 10 is unlocked, the second door lock switch 44 is switched to the interrupting state. As described above, the second door lock switch 44 switches between connection and disconnection of the door lock line 76 depending on whether the door 10 is locked or unlocked by the lock mechanism 28. The second door lock switch 44 and the first door lock switch 42 are not mechanically connected and operate independently of each other.

Figure 4:
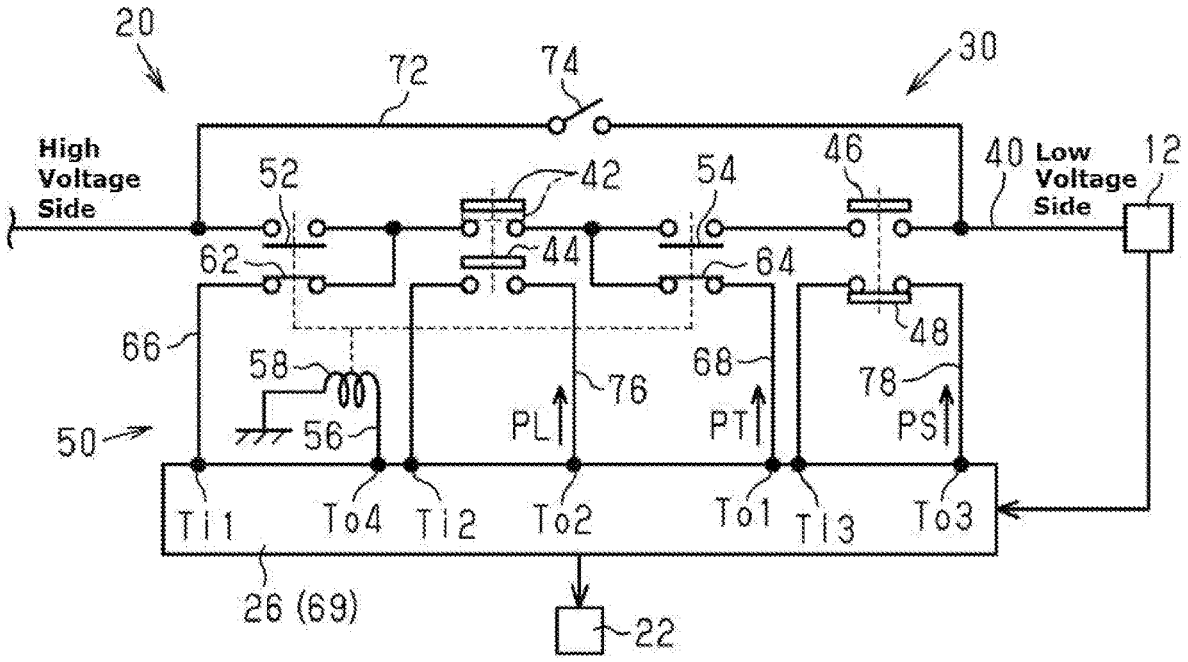
FIG. 4 is a circuit diagram of the notification device in a state where the door is opened.

A voltage is applied to the door lock line 76 from the second output terminal To2 of the door control unit 26. Thus, when the door control unit 26 controls the lock mechanism 28 so as to lock the door 10 and the second door lock switch 44 is switched to the conducting state, a voltage applied to the second output terminal To2 is supplied to the second input terminal Ti2 as a lock signal PL as shown in FIG. 2. Whereas when the door control unit 26 controls the lock mechanism 28 so as to unlock the door 10 and the second door lock switch 44 is switched to the interrupting state, the lock signal PL is not supplied to the second input terminal Ti2 as shown in FIG. 4.

A door close line 78 is electrically coupled to the door control unit 26 as shown in FIG. 2. One end of the door close line 78 is coupled to a third output terminal To3 of the door control unit 26. The other end of the door close line 78 is coupled to a third input terminal Ti3 of the door control unit 26. A second door close switch 48 is provided in the door close line 78. Although detailed illustration is omitted, opening and closing actions of the door 10 are transmitted to the second door close switch 48 via a transmission mechanism. Alternatively the opening and closing actions of the door 10 may be directly transmitted to the second door close switch 48. The second door close switch 48 is switched between a conducting state and an interrupting state in accordance with opening and closing of the door 10. The second door close switch 48 electrically connects the notification line 40 when the door 10 is opened. Whereas when the door 10 is fully closed, the second door close switch 48 electrically disconnects the notification line 40. Thus, the second door close switch 48 switches the door close line 78 between the conducted state and the interrupted state depending on whether the door 10 is fully closed or opened. The second door close switch 48 and the first door close switch 46 are not mechanically connected and operate independently of each other.

A voltage is applied to the door close line 78 from the third output terminal To3 of the door control unit 26. Thus, when the door control unit 26 controls the door 10 to be opened and the second door close switch 48 is switched to the conducting state, a voltage applied to the third output terminal To3 is supplied to the third input terminal Ti3 as a door open signal PS as shown in FIG. 4. Whereas when the door control unit 26 controls the door 10 to be closed and the second door close switch 48 is switched to the interrupting state, the door open signal PS is not supplied to the third input terminal Ti3 as shown in FIG. 2.

As shown in FIG. 2, one end of an excitation line 56 is coupled to a fourth output terminal To4 of the door control unit 26. The other end of the excitation line 56 is grounded. In the excitation line 56, an excitation coil 58 for switching between the conducting state and the interrupting state of the first interruption relay 52, the first determination relay 62, the second interruption relay 54, and the second determination relay 64 is provided. When the door control unit 26 applies a voltage to the excitation line 56, the excitation coil 58 is excited. Once the excitation coil 58 is excited, the first interruption relay 52 is switched to the interrupting state and the first determination relay 62 is switched to the conducting state. Further, the second interruption relay 54 is switched to the interrupting state and the second determination relay 64 is switched to the conducting state when the excitation coil 58 is excited. Whereas when the door control unit 26 stops applying the voltage to the excitation line 56, excitation of the excitation coil 58 is stopped. Once the excitation of the excitation coil 58 is stopped, the first interruption relay 52 is switched to the conducting state and the first determination relay 62 is switched to the interrupting state. Further the second interruption relay 54 is switched to the conducting state and the second determination relay 64 is switched to the interrupting state when the excitation of the excitation coil 58 is stopped.

In this embodiment, the first interruption relay 52, the first branch 66, the first determination relay 62, the second interruption relay 54, the second branch 68, the second determination relay 64, the excitation line 56, the excitation coil 58, and the door control unit 26 form an interruption unit 50 in the notification device 30.

Figure 3:
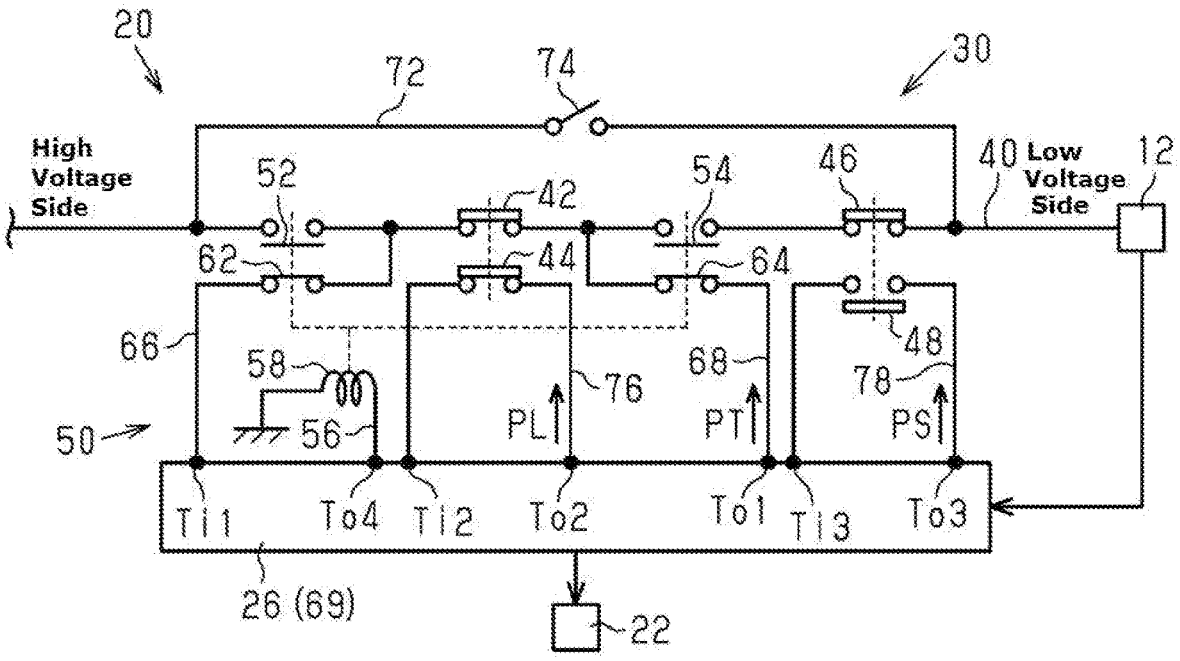
FIG. 3 is a circuit diagram of the notification device in a state where the door is locked and an excitation coil is excited.

A voltage from the first output terminal To1 of the door control unit 26 is applied to the second branch 68. Thus, when all of the second determination relay 64, the first door lock switch 42, and the first determination relay 62 are in the conducting state as shown in FIG. 3, the voltage is applied from the first output terminal To1 is supplied to the first input terminal Ti1 a branch conduction signal PT. Whereas when any one of the second determination relay 64, the first door lock switch 42, and the first determination relay 62 is in the interrupting state, the branch conduction signal PT is not supplied to the first input terminal Ti1.

When the door control unit 26 receives a command to open the door 10 from the vehicle control device 12, the door control unit 26 executes a door opening-closing process to open and close the door 10. During the door opening-closing process, the door control unit 26 determines whether any abnormality is detected in the first door lock switch 42. More specifically, the door control unit 26 determines whether the first door lock switch 42 is accidentally stuck to the notification line 40 while the first door lock switches 42 makes the notification line 40 in the conducted state. In other words, the door control unit 26 serves as a determination unit 69 that determines whether the first door lock switch 42 is stuck or not.

Steps of the door opening and closing process and an open or closed state of each switch or relay in each step will be now described. In the following description, an initial state of the door 10 before the door opening and closing process is started is defined as a state where the door 10 is fully closed and locked by the lock mechanism 28.

At the initial state of the door 10, the door control unit 26 does not apply a voltage to the excitation line 56 so that the excitation coil 58 is not excited. Therefore, the first interruption relay 52 and the second interruption relay 54 are in the conducting state as shown in FIG. 2. Further, since the door 10 is locked, the first door lock switch 42 is in the conducting state. Further the door 10 is fully closed so that the first door close switch 46 is in the conducting state.

Consequently, the notification line 40 becomes electrically conducting from the high-voltage-side end to the low-voltage-side end. A signal indicating that the door 10 is fully closed and locked is then supplied to the vehicle control device 12 through the notification line 40. That is, the notification line 40 notifies the vehicle control device 12 that the door 10 is fully closed and locked.

Figure 5:
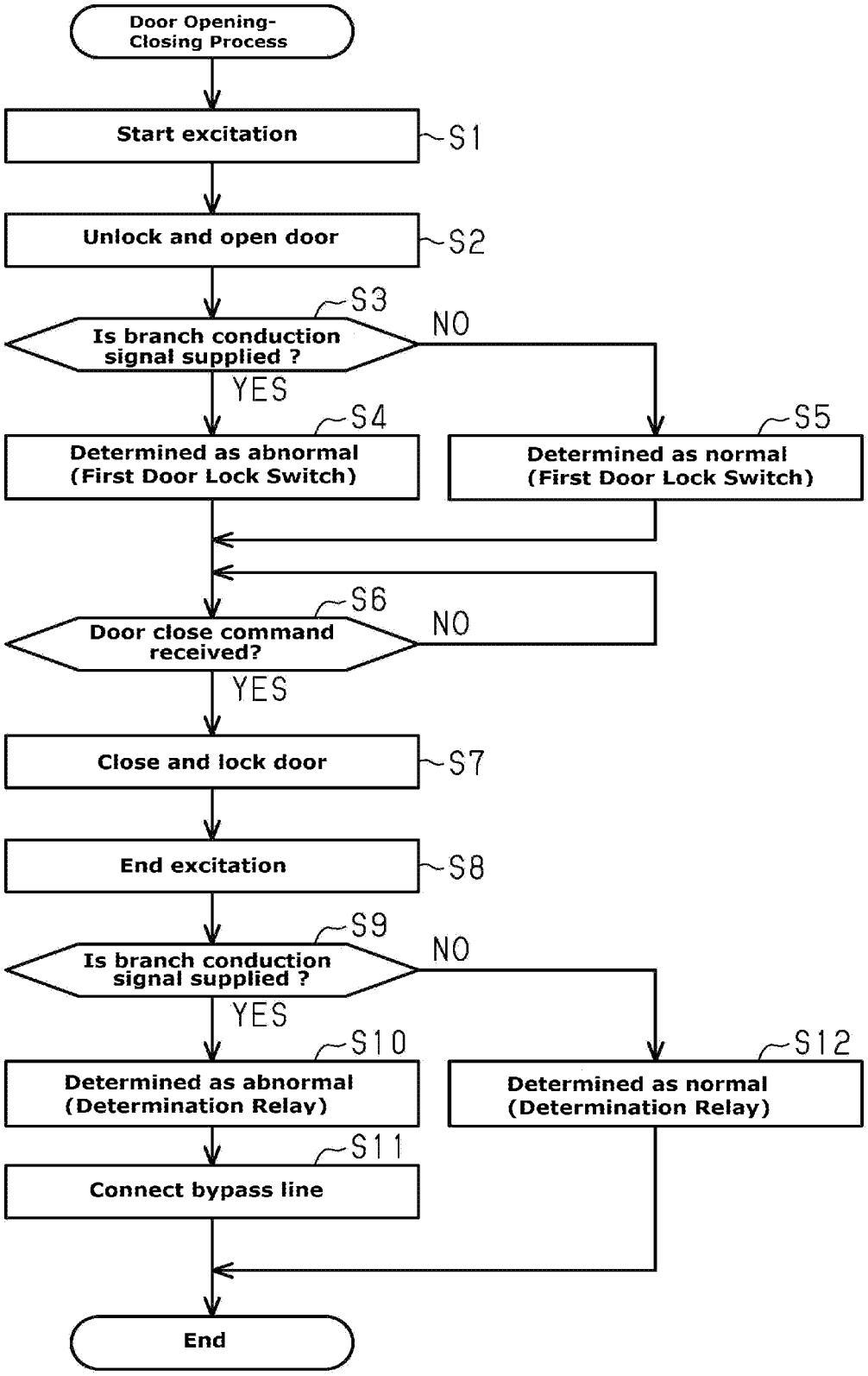
FIG. 5 is a flowchart steps of a door opening-closing process.

When the door 10 in the initial state is to be opened in response to reception of a command to open the door 10 from the vehicle control device 12, the door control unit 26 starts excitation of the excitation coil 58 by applying a voltage to the excitation line 56 in step S1 as shown in FIG. 5. Once the excitation coil 58 is excited, the first interruption relay 52 is switched to the interrupting state and the first determination relay 62 is switched to the conducting state in conjunction with the first interruption relay 52. Further, the second interruption relay 54 is switched to the interrupting state and the second determination relay 64 is switched to the conducting state in conjunction with the second interruption relay 54.

Referring to FIG. 5, the door control unit 26 first controls the lock mechanism 28 so as to unlock the door 10 in step S2. Accordingly, the first door lock switch 42 is switched to the interrupting state as shown in FIG. 4. Further, the second door lock switch 44 is switched to the interrupting state. Consequently, the door lock line 76 is disconnected, and the lock signal PL output from the second output terminal To2 of the door control unit 26 is not supplied to the second input terminal Ti2 of the door control unit 26. The door control unit 26 determines that unlocking of the door 10 has been completed when the supply of the lock signal PL is stopped.

Once the supply of the lock signal PL to the second input terminal Ti2 of the door control unit 26 is stopped, the door control unit 26 controls the electric motor 22 such that the door 10 is opened. At this point, the first door close switch 46 is switched to the interrupting state as shown in FIG. 4. Further, the second door close switch 48 is switched to the conducting state. Consequently, the door close line 78 is electrically connected, and the door open signal PS output from the third output terminal To3 of the door control unit 26 is supplied to the third input terminal Ti3 of the door control unit 26. The door control unit 26 determines that the door 10 has been switched from the closed state to the open state based on the door open signal PS supplied. Thereafter the door control unit 26 proceeds to step S3 as shown in FIG. 5.

In step S3, the door control unit 26 determines whether the branch conduction signal PT is supplied to the first input terminal Ti1. Here, since the excitation coil 58 is excited in the above-described step S1, the second determination relay 64 and the first determination relay 62 are both in the conducting state as shown in FIG. 4. On the other hand, unlocking of the door 10 has been completed in step S2 described above before step S3 starts. Therefore, when the first door lock switch 42 works normally, the first door lock switch 42 should be in the interrupting state. Accordingly, the signal path including the second branch 68, the notification line 40 (first door lock switch 42), and the first branch 66 is interrupted by the first door lock switch 42. Consequently, when the first door lock switch 42 works normally, the branch conduction signal PT outputted from the first output terminal To1 of the door control unit 26 is not supplied to the first input terminal Ti1 of the door control unit 26. In this case, the door control unit 26 determines that the branch conduction signal PT is not supplied (step S3: NO), and proceeds to step S5 as shown in FIG. 5. In step S5, the door control unit 26 determines that the first door lock switch 42 works normally.

Whereas when the first door lock switch 42 is stuck, the first door lock switch 42 that should have been in the interrupting state is actually in the conducting state (see the two-dot chain line in FIG. 4). Thus the signal path including the second branch 68, the notification line 40 (first door lock switch 42), and the first branch 66 becomes electrically conductive. Therefore, if the first door lock switch 42 is stuck, the branch conduction signal PT outputted from the first output terminal To1 of the door control unit 26 is supplied to the first input terminal Ti1 of the door control unit 26. In this case, the door control unit 26 determines that the branch conduction signal PT is supplied (step S3: YES), and proceeds to step S4 as shown in FIG. 5. In step S4, the door control unit 26 determines that the first door lock switch 42 works abnormally. The door control unit 26 further stores in its memory unit that the first door lock switch 42 is stuck.

As shown in FIG. 5, after step S4 or step S5, the door control unit 26 determines whether it has received a command to close the door 10 from the vehicle control device 12 in step S6. When the door control unit 26 has not received the command to close the door 10 (step S6: NO), the door control unit 26 executes step S6 again. In this manner, the door control unit 26 repeats step S6 until it receives the command to close the door 10. When the door control unit 26 received the command to close the door 10 (step S6: YES), the process proceeds to step S7.

In step S7, the door control unit 26 first controls the electric motor 22 so as to close the door 10. At this point, the first door close switch 46 is switched to the conducting state as shown in FIG. 3. Further, the second door lock switch 48 is switched to the interrupting state. Consequently, the door close line 78 is interrupted, and the door open signal PS output from the third output terminal To3 of the door control unit 26 is no longer supplied to the third input terminal Ti3 of the door control unit 26. The door control unit 26 determines that the door 10 has been switched from the opened state to the closed state based on the fact that the door open signal PS is not supplied.

Once the supply of the door open signal PS to the third input terminal Ti3 of the door control unit 26 is stopped, the door control unit 26 controls the lock mechanism 28 to lock the door 10. Accordingly the first door lock switch 42 is switched to the conducting state as shown in FIG. 3. Further, the second door lock switch 44 is switched to the conducting state. Consequently, the door lock line 76 becomes conductive and the lock signal PL output from the second output terminal To2 of the door control unit 26 is supplied to the second input terminal Ti2 of the door control unit 26. The door control unit 26 determines that locking of the door 10 has been completed when the supply of the lock signal PL is started.

Note that the door close line 78 and the door lock line 76 are both signal paths different from the notification line 40. Therefore it is possible to determine whether the door 10 is fully closed or locked based on the door open signal PS supplied to the door close line 78 and the lock signal PL supplied to the door lock line 76 without depending on the signal supplied from the notification line 40 to the vehicle control device 12, in other words, independently from the notification through the notification line 40. Thereafter the door control unit 26 proceeds to step S8 as shown in FIG. 5.

In step S8, the door control unit 26 ends the voltage application to the excitation line 56 to end the excitation of the excitation coil 58. Once the excitation of the excitation coil 58 is ended, the first interruption relay 52 is switched to the conducting state and the first determination relay 62 is switched to the interrupting state in conjunction with the first interruption relay 52. Further, the second interruption relay 54 is switched to the conducting state and the second determination relay 64 is switched to the interrupting state in conjunction with the second interruption relay 54.

As shown in FIG. 5, after step S8, the door control unit 26 determines whether the branch conduction signal PT is supplied to the first input terminal Ti1 in step S9. The locking of door 10 has been completed in step S7 as described above before step S8 starts. Thus the first door lock switch 42 is in the conducting state. At this time, since excitation of the excitation coil 58 has been ended in the above-described step S8, the second determination relay 64 and the first determination relay 62 both should be in the interrupting state as shown in FIG. 2 if they work normally. Thus the signal path including the second branch 68, the notification line 40 (first door lock switch 42), and the first branch 66 is interrupted by the second determination relay 64 and the first determination relay 62. Consequently, when at least one of the second determination relay 64 and the first determination relay 62 works normally, the branch conduction signal PT outputted from the first output terminal To1 of the door control unit 26 is not supplied to the first input terminal Ti1 of the door control unit 26. Accordingly the door control unit 26 determines that the branch conduction signal PT is not supplied (step S9: NO), and proceeds to step S12 as shown in FIG. 5. In step S12, the door control unit 26 determines that at least one of the second determination relay 64 and the first determination relay 62 works normally. Thereafter, a series of door opening and closing processes by the door control unit 26 is completed.

Whereas when the second determination relay 64 and the first determination relay 62 are both stuck, the second determination relay 64 and the first determination relay 62 that should have been in the interrupting state remain in the conducting state. (see FIG. 3). Thus the signal path including the second branch 68, the notification line 40 (first door lock switch 42), and the first branch 66 becomes electrically conducting. Consequently, when both the second determination relay 64 and the first determination relay 62 are stuck, the branch conduction signal PT outputted from the first output terminal To1 of the door control unit 26 is supplied to the first input terminal Ti1 of the door control unit 26. In this case, the door control unit 26 determines that the branch conduction signal PT is supplied (step S9: YES), and proceeds to step S10 as shown in FIG. 5. In step S10, the door control unit 26 determines that the second determination relay 62 and the first determination relay 64 work abnormally. The door control unit 26 further stores in its memory unit that the first determination relay 62 and the second determination relay 64 are stuck.

After determining the abnormality in step S10, the door control unit 26 switches the bypass switch 74 to the conducting state in step S11. Thereby the bypass line 72 is electrically connected. Thereafter, a series of steps in the door opening and closing process by the door control unit 26 is completed.

Advantageous effects of the embodiment will be now described. (1) When the door 10 is opened, the second determination relay 64 and the first determination relay 62 are switched to the conducting state, and the second branch 68 and the first branch 66 are electrically connected. In this state, if the first door lock switch 42 is stuck, the branch conduction signal PT is supplied to the first input terminal Ti1 of the door control unit 26 via the second branch 68, the notification line 40 (first door lock switch 42), and the first branch 66. In this way, it is possible for the door control unit 26 to determine whether the first door lock switch 42 is stuck based on whether the branch conduction signal PT is supplied to the first input terminal Ti1 or not.

(2) As the second branch 68 and the first branch 66 are electrically connected, the second interruption relay 54 and the first interruption relay 52 are switched to the interrupting state. Thus the notification line 40 is interrupted when an abnormality (sticking) of the first door lock switch 42 is detected. Therefore, even if the first door lock switch 42 is stuck, the vehicle control device 12 is not notified through the notification line 40 that the door 10 is closed when the abnormality of the first door lock switch 42 is detected.

(3) When determining whether the first door lock switch 42 is stuck, the branch conduction signal PT is output from the first output terminal To1 of the door control unit 26. At this time, since the second interruption relay 54 is switched to the interrupting state, the branch conduction signal PT is not supplied to the vehicle control device 12 and the other notification device 30 provided on the high voltage side through the notification line 40. Therefore, the vehicle control device 12 does not mistakenly take the branch conduction signal PT as a signal indicating that the door 10 is in the closed state.

(4) The circuit for determining whether the first door lock switch 42 is stuck and the circuit for interrupting the notification line 40 when determining the abnormality of the first door lock switch 42 are relatively simple such that they are formed by simple circuit configurations such as the first branch 66, the second branch 68, the first determination relay 62, and the second determination relay 64. Therefore, for a device in which a door lock switch is provided on the notification line 40, it is possible to determine whether the switch is stuck and the interruption of the notification line 40 with a relatively simple configuration.

(5) When it is determined that the first determination relay 62 and the second determination relay 64 are stuck, the first interruption relay 52 and the second interruption relay 54 that are mechanically coupled thereto respectively are in the interrupting state so that the notification line 40 is interrupted. In this case, whatever signal is supplied by other notification device 30 on the high voltage side, the signal is interrupted by the first interruption relay 52 and never supplied to the vehicle control device 12 on the low voltage side. In this regard, the bypass line 72 is electrically connected by making the bypass switch 74 to the conducting state in the above embodiment. Therefore, even when the first interruption relay 52 and the second interruption relay 54 are in the interrupting state, it is possible to supply signals from other notification device 30 and a high voltage power source connected to the high voltage side than the notification device 30 to other notification device and the vehicle control device 12 connected to the low voltage side.

(6) After the notification line 40 is interrupted by the first interruption relay 52 and the second interruption relay 54, when it is determined the door 10 has been fully closed and locked through the door opening signal PS and the lock signal PL, the first interruption relay 52 and the second interruption relay 54 are switched to the conducting state and the notification line 40 become conductive. Therefore, it is possible to prevent the situation where the notification line 40 is interrupted and a signal cannot be supplied to the vehicle control device 12 via the notification line 40 from continuing for an excessively long period.

The foregoing embodiments can be modified as described below. The above embodiment and the following modifications can be implemented in combination to the extent where they are technically consistent to each other.

There may be a case where both or one of the first interruption relay 52 and the second interruption relay 54 are stuck to the notification line 40. In this case, when the excitation coil 58 is excited in step S1 in the door opening-closing process, the first determination relay 62 and the second determination relay 64 corresponding to the first interruption relay 52 and the second interruption relay 54 that is/are stuck become in the interrupting state. Thus both or one of the first branch 66 and the second branch 68 are/is interrupted, and the branch conduction signal PT is not supplied to the door control unit 26. In consideration of this, if the branch conduction signal PT is not supplied to the door control unit 26 when the excitation coil 58 is excited in step S1, it may be determined that one or both of the first interruption relay 52 and the second interruption relay 54 is/are stuck to the notification line 40. This determination result may be stored in the memory unit of the door control unit 26. When the interruption relays 52 and 54 are stuck, it is impossible to determine whether the first door lock switch 42 is stuck using the branch conduction signal PT, but there is no influence on the opening and closing operations of the door 10. Therefore, the door opening-closing process may be continued even after it has been determined that the interruption relays 52, 54 are stuck. As described above, when the interruption relays 52 and 54 are stuck, it is impossible to detect sticking of the first door lock switch 42. Therefore, when the interruption relays 52 and 54 are stuck, it is preferable to store in the memory unit of the door control unit 26 that the determination of the sticking of the first door lock switch 42 has not been executed.

There may be a case where the second door lock switch 44 is stuck to the door lock line 76. In this case, when the lock mechanism 28 is controlled to release the lock of the door 10 in step S2 in the door opening-closing process, the second door lock switch 44 conducts the door lock line 76 and the door control unit 26 is supplied with the lock signal PL. Considering this, it may be determined that the second door lock switch 44 is stuck to the door lock line 76 if the lock signal PL is still supplied to the door control unit 26 even after a predetermined time (for example, several seconds) has elapsed after the lock mechanism 28 was controlled to unlock the door 10 in step S2. This determination result may be stored in the memory unit of the door control unit 26. Even if the second door lock switch 44 is stuck to the door lock line 76, the opened or closed state of the door 10 can be detected based on the presence or absence of the door open signal PS, and at least the open and close operations of the door 10 are not affected. Therefore, after determining that the second door lock switch 44 is stuck, the door opening-closing process may be continued. As described above, when the second door lock switch 44 is stuck, the door control unit 26 is unable to detect that the door 10 has been locked or unlocked based on the supply of the lock signal PL. Therefore, when the second door lock switch 44 is stuck, it is preferable to store, in the memory unit of the door control unit 26, the fact that the lock signal PL cannot be used for detection of the locked and unlocked state of the door 10.

There may be a case where the second door close switch 48 is stuck to the door close line 78. In this case, when the motor 22 is controlled to close the door 10 in step S7 of the door opening-closing process, the second door close switch 48 conducts the door close line 78 and the door control unit 26 is supplied with the door open signal PS. Considering this, it may be determined that the second door close switch 48 is stuck to the door close line 78 if the door open signal PS is still supplied to the door control unit 26 even after a predetermined time (for example, several seconds) has elapsed after the motor 22 was controlled to close the door 10 in step S7. This determination result may be stored in the memory unit of the door control unit 26. Even if the second door close switch 48 is stuck, the opened or closed state of the door 10 can be detected based on the presence or absence of the lock signal PL, and at least the open and close operations of the door 10 are not affected even if the second door lock switch 44 is stuck. Therefore, after determining that the second door lock switch 44 is stuck, the door opening-closing process may be continued. As described above, when the second door close switch 48 is stuck, the door control unit 26 is unable to detect the opened or closed state of the door 10 based on the door open signal PS. Therefore, when the second door close switch 48 is stuck, it is preferable to store, in the memory unit of the door control unit 26, the fact that the door open signal PS cannot be used for detection of the opened or closed state of the door 10.

The first door lock switch 42 and the second door lock switch 44 may be mechanically coupled to each other.

The first door close switch 46 and the second door close switch 48 may be mechanically coupled to each other.

Any one or all selected from the group consisting of the first input terminal Ti1, the second input terminal Ti2, and the third input terminal Ti3 of the door control unit 26 may be omitted. Instead, a corresponding input terminal(s) may be provided to a control unit different from the door control unit 26. Similarly, Any one or all selected from the group consisting of the first output terminal To1, the second output terminal To2, the third output terminal To3, and the fourth output terminal To4 of the door control unit 26 may be omitted. Instead, a corresponding input terminal(s) may be provided to a control unit different from the door control unit 26. In other words, the input terminals and the output terminals of the door control unit 26 are not necessarily provided in the same control unit. When an input terminal and an output terminal that form a pair are provided in different control units, the different control units are configured to be interconnected to receive a control signal therebetween. In addition, the vehicle control device 12 or the like may be the control unit different from the door control unit 26. When an input terminal corresponding to the first input terminal Ti1 is provided on a control unit different from the door control unit 26, the control unit different from the door control unit 26 serves as a determination unit that determines whether the first door lock switch 42 is stack.

All of the first input terminal Ti1, the second input terminal Ti2, and the third input terminal Ti3, the first output terminal To1, the second output terminal To2, the third output terminal To3, and the fourth output terminal To4 may be provide on a control unit different from the door control unit 26. In this case, the control unit different from the door control unit 26 serves as the determination unit that determines whether the first door lock switch 42 is stuck.

The second branch 68, the second determination relay 64, the first branch 66, and the first determination relay 62 may be omitted, and the sticking of the first door lock switch 42 may be detected with a different circuit or element. For example, a position monitoring sensor that detects the position of the first door lock switch 42 may be provided in the vicinity of the first door lock switch 42. In this case, when the lock mechanism 28 is controlled so as to unlock the door 10, the position monitoring sensor detects whether the first door lock switch 42 has moved, thereby detecting the sticking of the first door lock switch 42. Alternatively, a monitoring camera may be provided in the vicinity of the first door lock switch 42, and the operation of the first door lock switch 42 is monitored through the camera when the lock mechanism 28 is controlled so as to unlock the door 10 in order to detect the sticking of the door lock switch 42. Even when the sticking of the first door lock switch 42 is detected without using the interruption unit 50 as described above, the signal indicating that the door 10 is closed will not be supplied to the vehicle control apparatus 12 during the detection of the sticking as long as at least one of the first interruption relay 52 and the second interruption relay is made in the interrupting state.

Instead of detecting the sticking of the first door lock switch 42, any other abnormalities of the first door lock switch 42 may be detected. For example, by using the position monitoring sensor, the monitoring camera or the like in the above modification example, it is possible to detect abnormal situations where the first door lock switch 42 remains in the interrupting state and it is not possible to switch its state, the first door lock switch 42 is broken and the like. If the notification line 40 is interrupted by the first interruption relay 52 and/or the second interruption relay 54 during the detection of an abnormality of the first door lock switch 42 other than the sticking, the notification line 40 will be interrupted by the first interruption relay 52 and/or the second interruption relay 54 when the abnormality of the first door lock switch 42 other than the sticking is actually detected.

If any abnormality of the first door lock switch 42 is detected, the notification line 40 may be interrupted by the first interruption relay 52 or the second interruption relay 54 regardless of whether the door 10 is opened or closed. For example, when an abnormality of the first door lock switch 42 is detected, the notification line 40 may be interrupted at that time. Further, after the notification line 40 is interrupted in response to the detection of the abnormality of the first door lock switch 42, the notification line 40 may be kept interrupted regardless of whether the door 10 is opened or closed. More specifically, in the above embodiment, the excitation coil 58 may continue to be excited after the abnormality is detected in step S4. In this case, it is preferable that the bypass line 72 be electrically connected by the bypass switch 74. As described above, it is only necessary that the first interruption relay 52 and the second interruption relay 54 are configured to interrupt the notification line 40 when an abnormality of the first door lock switch 42 is detected.

The door close line 78 and the second door close switch 48 may be omitted. In this case, the closed state of the door 10 may be determined through other circuit or elements. For example, if the electric motor 22 is capable of determining the rotational position of the output shaft like a stepping motor or a servo motor, the position of the door 10 can be estimated based on the amount of power supplied to the electric motor 22. When it is estimated that the position of the door 10 is the closed position, it may be determined that the door 10 has been closed. Alternatively, for example, the position of the door 10 may be detected by a laser sensor or the like, and it may be determined that the door 10 has been closed when the position of the door 10 has reached to the position of the closed state.

When it is determined that the door 10 is in the closed state with a configuration different from the door close line 78 and the second door close switch 48 like the above modification example, the door close line 78 and the second door close switch 48 may be removed. In this case, the door close line 78 and the second door close switch 48 are not essential.

In place of the door lock line 76 and the second door lock switch 44, other circuit or elements can be used to determine that the door 10 is locked. For example, a sensor that detects the position of the lock pin protruding from the lock mechanism 28 may be provided, and whether the door 10 is locked by the lock mechanism 28 may be determined based on a position of the pin detected by the sensor.

When it is determined that the door 10 is locked through a configuration different from the door lock line 76 and the second door close switch 44 like the above modification example, the door lock line 76 and the second door close switch 44 may be removed. In this case, the door lock line 76 and the second door close switch 44 are not essential.

In the embodiment and the modification examples described above, the first door lock switch 42 is the target of abnormality detection. However, instead of or in addition to the first door lock switch 42, the first door close switch 46 may also be the target of abnormality detection. When whether the first door close switch 46 is stuck or not is detected as the abnormality, branches corresponding to the first branch 66 and the second branch 68 and relays for connecting and disconnecting these branches are provided on the two sides of the first door close switch 46 respectively in the notification line 40. Relays that interrupt and conduct the notification line 40 in conjunction with the above-mentioned relays and that correspond to the first interruption relay 52 and the second interruption relay 54 may be provided in the notification line 40. In this case, similarly to the first door lock switch 42 in the above embodiment, the notification line 40 is interrupted by the interruption unit 50 when sticking of the first door close switch 46 is detected.

The bypass line 72 may be electrically connected even when the first determination relay 62 and the second determination relay 64 are not stuck. The bypass line 72 may become conductive in a situation where it is desired to isolate the first door lock switch 42, the first door close switch 46, the first interruption relay 52, and the second interruption relay 54 and to electrically connect the notification line 40. For example, when the first door lock switch 42 or the first door close switch 46 works abnormally and it is desired to avoid using these switches, the bypass line 72 may be electrically connected.

The bypass line 72 may be omitted.

Regarding the first door lock switch 42 and the first door close switch 46, as long as at least one of them is electrically connected to the notification line 40, the other may be omitted. As long as at least one of the first door lock switch 42 and the first door close switch 46 is electrically connected to the notification line 40, it is possible to switch the notification line 40 to the conducting state when the door 10 is closed. In the case where the first door lock switch 42 is removed, an abnormality of the first door close switch 46 may be determined instead as in the above-described example.

The first door close switch 46 and the first door lock switch 42 may make the notification line 40 conductive even when something is caught in the door set 10 and therefore there is a gap between the two leaves of the door set 10, that is, when the door 10 is not fully closed. In this case, a means for detecting such catching by the door 10 may be provided and when something caught is detected by the detecting means, the notification line 40 may be interrupted by the first interruption relay 52 or the second interruption relay 54. In this way, the notification line 40 will not become conductive while something is caught in the door.

The configuration of the door opening-closing device in the above embodiment is merely an example. For example, the lock mechanism is not limited to the above embodiment and may have any configuration as long as the door 10 can be locked in the fully closed state and can be unlocked. The lock mechanism may be controlled by the electric motor 22 that drives the door 10 to be opened and closed.

In place of the electric motor 22, the opening and closing operations of the door 10 may be controlled by a pneumatic cylinder.

The control unit that controls the notification device 30 and the control unit that controls the electric motor 22 and the lock mechanism 28 may be configured as separate control units.

The notification line 40, the branches and the like may be configured by an optical fiber instead of electric wirings. The relays and switches provided in the notification line, branches and the like may be formed using optical switches. Even in this case, the optical switches may be operated in the same manner as the relays and switches of the above-described embodiment to pass or interrupt an optical signal of the optical fiber. For example, when the optical switch corresponding to the first door lock switch 42 fails and does not work while the optical signal is passing through the notification line, the failure can be detected with the above mentioned configuration.

What is claimed is:

1. A notification device, comprising:

a notification line for notifying an upper-level device that a door is closed;

a door switch allowing the notification line to be in a signal transmitted state when the door is closed and allowing the notification line to be in a signal interrupted state when the door is opened; and an interruption unit allowing the notification line to be in the signal interrupted state when an abnormality of the door switch is detected;

wherein the interruption unit includes:

a first branch branched from the notification line on one side of the notification line with reference to the door switch;

a first determination relay causing the first branch to be in a signal transmitted state or a signal interrupted state;

a second branch branched from the notification line on the other side of the notification line with reference to the door switch;

a second determination relay causing the second branch to be in a signal transmitted state or a signal interrupted state; and a determination unit determining that the door switch is stuck while the door switch keeps causing the notification line to be in the signal transmitting state when the first determination relay causing the first branch to be in the signal transmitted state, the second determination relay causing the second branch to be in the signal transmitted state, the door is opened, and a signal is supplied via the first branch and the second branch.

2. The notification device of claim 1, wherein the interruption unit detects whether the door switch is stuck while the notification line is in the signal transmitted state, and the interruption unit causes the notification line to be in the signal interrupted state when it is determined that the door switch is stuck and an abnormality of the door switch has occurred.

3. The notification device of claim 1, wherein the interruption unit switches the notification line from the signal interrupted state to the signal transmitted state on condition that a closed state of the door is detected.

4. The notification device of claim 1, wherein the interruption unit includes:

a first interruption relay provided in the first branch on the one side of the notification line with respect to a branching point of the first branch, the first interruption relay allowing the notification line to be in the signal interrupted state in conjunction with the first determination relay causing the first branch to be in the signal transmitted state, and the first interruption relay allowing the notification line to be in the signal transmitted state in conjunction with the first determination relay causing the first branch to be in the signal interrupted state; and a second interruption relay provided in the second branch on the other side of the notification line with respect to a branching point of the second branch, the second interruption relay allowing the notification line to be in the signal interrupted state in conjunction with the second determination relay causing the second branch to be in the signal transmitted state, and the second interruption relay allowing the notification line to be in the signal transmitted state in conjunction with the second determination relay causing the second branch to be in the signal interrupted state, wherein the determination unit determines whether the door switch is stuck while the notification line is made in the signal interrupted state by the first interruption relay and the second interruption relay.

5. The notification device of claim 4, further comprising:

a bypass line connecting the one side of the notification line with respect to the first interruption relay and the other side of the notification line with respect to the second interruption relay; and a bypass switch allowing the bypass line to be in a signal transmitted state or a signal interrupted state.

6. The notification device of claim 1, wherein the door switch is a door lock switch that allows the notification line to be in the signal transmitted state when the door is closed and locked and allows the notification line to be in the signal interrupted state when the door is unlocked.

7. A door opening-closing device, comprising:

a driving device driving a door to be opened and closed;

a control unit controlling the driving device; and a notification device, wherein the notification device includes:

a notification line for notifying an upper-level device that the door is closed;

a door switch allowing the notification line to be in a signal transmitted state when the door is closed and allowing the notification line to be in a signal interrupted state when the door is opened; and an interruption unit allowing the notification line to be in the signal interrupted state when an abnormality of the door switch is detected;

wherein the interruption unit includes:

a first branch branched from the notification line on one side of the notification line with reference to the door switch;

a first determination relay causing the first branch to be in a signal transmitted state or a signal interrupted state;

a second branch branched from the notification line on the other side of the notification line with reference to the door switch;

a second determination relay causing the second branch to be in a signal transmitted state or a signal interrupted state; and a determination unit determining that the door switch is stuck while the door switch keeps causing the notification line to be in the signal transmitting state when the first determination relay causing the first branch to be in the signal transmitted state, the second determination relay causing the second branch to be in the signal transmitted state, the door is opened, and a signal is supplied via the first branch and the second branch.

* * * * *